US005750464A

United States Patent [19]

Dombrowski, Jr. et al.

[11] Patent Number: 5,750,464

[45] Date of Patent: May 12, 1998

[54] THERMOGRAPHIC RECORDING

[75] Inventors: Edward J. Dombrowski, Jr., Bellingham, Mass.; Donna J. Guarrera, Addlestone, England; Robert L. Jones, Dracut, Mass.; Mark R. Mischke, Arlington, Mass.; John C. Warner, Norwood, Mass.; Jiyue Yang, Warwick, N.Y.

[73] Assignee: Polaroid Corporation, Cambridge, Mass.

[21] Appl. No.: 837,775

[22] Filed: Apr. 22, 1997

[51] Int. Cl.[6] ..... B41M 5/32

[52] U.S. Cl. ..... 503/204; 503/202; 503/209; 503/210; 503/220; 503/224

[58] Field of Search ..... 427/150–152; 503/202, 204, 209, 210, 220, 224

[56] References Cited

U.S. PATENT DOCUMENTS

| | | | |
|---|---|---|---|
| 4,904,572 | 2/1990 | Dombrowski, Jr. et al. | 430/332 |
| 4,970,309 | 11/1990 | King | 544/278 |
| 5,028,725 | 7/1991 | King | 556/113 |
| 5,153,169 | 10/1992 | Freedman et al. | 503/209 |
| 5,196,297 | 3/1993 | Dombrowski, Jr. et al. | 430/338 |
| 5,198,406 | 3/1993 | Mack et al. | 503/207 |
| 5,220,036 | 6/1993 | King | 549/52 |
| 5,278,127 | 1/1994 | Dombrowski et al. | 503/207 |
| 5,411,929 | 5/1995 | Ford et al. | 503/210 |
| 5,480,855 | 1/1996 | Dombrowski et al. | 503/207 |
| 5,489,855 | 2/1996 | Dombrowski et al. | 503/207 |

FOREIGN PATENT DOCUMENTS 0 250 558 B1 5/1990 European Pat. Off. .

*Primary Examiner*—Bruce H. Hess
*Attorney, Agent, or Firm*—Jennifer A. Kispert

[57] ABSTRACT

There is described a novel thermographic recording film, and more specifically, a novel image-forming system incorporated therein comprising at least one layer and including and a Lewis acid material, a di- or triarylmethane thiolactone dye precursor, an acidic organic material, a binder and a thermal stabilizer.

Thermographic recording films comprising the novel image-forming system of the present invention exhibit excellent thermal stability, and desirable minimum optical densities, indicative of substantially less premature image development at elevated environmental temperatures.

Embodiments of the invention wherein the thermographic recording films further include a light insensitive organic silver salt, a reducing agent, a binder and, preferably, a toning agent, show substantially enhanced image density.

21 Claims, No Drawings

THERMOGRAPHIC RECORDING

The present invention relates to thermographic recording films, and more specifically, it relates to the use of novel image-forming system incorporated therein comprising at least one layer and including a Lewis acid material, a di- or triarylmethane thiolactone dye precursor, an acidic organic material, a binder and a thermal stabilizer. Thermographic recording films comprising the novel image-forming system exhibit excellent thermal stability and substantially less premature image development at elevated environmental temperatures.

BACKGROUND OF THE INVENTION

Thermographic recording films utilizing thiolactone chemistry are known in the art, such as, for example, those described in European Patent No. 250,558 and U.S. Pat. Nos. 4,904,572; 4,970,309; 5,028,725; 5,196,297; 5,198,406; 5,220,036; 5,278,127; 5,411,929; 5,480,855; and 5,489,566.

Further, it is known in the art that image-forming systems incorporated in thermographic recording materials may employ thiolactone chemistry which utilizes color-forming di- and triarylmethane compounds possessing certain sulfur-containing ring closing moieties, namely a thiolactone, dithiolactone or thioether ring closing moiety. These colorless dye precursors undergo coloration by contacting with a Lewis acid material such as a metal ion of a heavy metal, generally silver, capable of opening the sulfur-containing ring moiety to form a colored metal-complex. More specifically, upon imagewise heating, the lactone or lactam ring closed on the methane carbon atom is opened and colored by an ionization or hydrogen bonding reaction when contacted with the Lewis acid material, e.g., silver behenate. The ability of such dye precursors to form a colored dye almost instantaneously when contacted with $Ag^+$renders them eminently suitable for use as color formers in thermal imaging systems employing such organic silver salts.

As described in U.S. Pat. Nos. 4,904,572 and 5,196,297, in addition to a di- or triarylmethane thiolactone dye precursor and a Lewis acid material such as a light insensitive organic silver salt, the image-forming system described above further comprises a binder and an acidic organic material, preferably, 3,5-dihydroxybenzoic acid, which upon imagewise heating of the recording film to the processing temperature, provide an improved reaction medium for facilitating contact and reaction of the thiolactone dye precursor and the $Ag^+$, liberated from the melted light insensitive organic silver salt, to produce the dye image.

It would be appreciated by those of skill in the art that premature interaction, i.e., before imagewise heating, facilitated by, e.g., elevated environmental temperatures, of the above-mentioned components of an image-forming system utilizing thiolactone chemistry would result in undesirable premature image development which would, in turn, increase the minimum optical density ($D_{min}$) of the medium.

For example, U.S. Pat. No. 5,411,929 discloses that thermographic recording films, after coating, may be dried at ambient or elevated temperatures provided that the temperature is not sufficient to effect premature color formation. It would also be understood by those of skill in the art that pre-imagewise heated thermographic recording films exposed to environmental extremes of temperature but below the temperatures at which the imagewise heating occurs, such as at least about 70° C., for at least about 24 hours, will exhibit undesirable premature image development due to the ambient heat.

Therefore, in thermally-processable systems using thermographic recording films which include such image-forming systems, and which are likely to be exposed to environmental extremes of temperature, it would be advantageous to develop novel image-forming systems, the use of which in thermographic films, would result in a substantial reduction or preclusion of such premature interactions.

It is known to the art, for example, as disclosed and claimed in U.S. Pat. No. 5,489,566, to reduce the possibility of the premature interaction of the reactive components of an image-forming system utilizing the above-mentioned thiolactone chemistry by providing a thermographic recording material comprising an image-forming system wherein the thiolactone dye precursor and the acidic organic material are separated from each other, e.g., the thiolactone dye precursor, the light insensitive organic silver salt and a binder are coated together in a first layer, and the acidic organic material, e.g., 3,5-dihydroxybenzoic acid, and a binder, are coated in a second layer adjacent to the first layer. See also, U.S. Pat. No. 5,411,929.

However, as is known in the art, for example, as described in U.S. Pat. No. 5,196,297, it is preferred that the image-forming system comprise a layer which includes the dye precursor, the Lewis acid material, the binder and the acidic organic material; hence, it would be advantageous to develop a thermographic recording material wherein these reactive components may be present in a single layer, but do not, by virtue of their being coated together in one imaging layer, appreciably interact due to ambient heat prior to imagewise heating, resulting in an increased minimum optical density ($D_{min}$) or background.

Hindered amines are well known in the thermal imaging art for use as light stabilizers (hindered amine light stabilizers or ("HALS") to prevent the photodegradation of polymers, e.g., in a coating, and function by scavenging the free radicals formed by the photodegradation of such polymers, as opposed to absorbing harmful ultraviolet (UV) radiation, commonly referred to as ultraviolet light absorbers or "UVAs," to protect the, e.g., coating.

Polymers incorporated in recording films by, e.g., coatings, may absorb UV radiation which can break down the chemical bonds in the polymers' structures leading to decreased performance and undesirable appearance changes in the coatings. For example, the degradation of a binder may result in cracking, checking, loss of gloss, chalking, pigment fading, delamination or peeling, yellowing, and loss of physical and protective properties of the coating.

As mentioned above, and as described, for example, in U.S. Pat. Nos. 5,196,297; 5,198,406; 5,278,127; 5,411,929; 5,480,855; and 5,489,566, UVAs, may be incorporated in a recording material, e.g., within protective, topcoat and/or overcoat layers, to absorb incident UV radiation and convert it into harmless levels of heat energy which are dissipated throughout the coating. Alternatively, instead of using UVAs to absorb the incident radiation, HALS may be incorporated to scavenge the free radicals produced by the breakage of the chemical bonds of the polymer, e.g., in the coating, which absorbed the incident UV radiation. Further yet, both UVAs and HALS may be incorporated in a recording material to achieve optimum coatings protection against light instability.

Consistent with the statements above, and in recognition of the fact that a UVA layer provided in some imaging systems is insufficient by itself to prevent unwanted color development, or "photocoloration," due to the absorption of incident UV light, U.S. Pat. No. 5,153,169 describes the use of a color stabilizer, e.g., a hindered amine light stabilizer, preferably, along with an ultraviolet absorber, in an imaging medium to prevent development of color in the medium during storage before and after imaging by reducing or eliminating the photoinstability of the imaging medium, i.e., the tendency of the medium, without heating, to develop color when it is exposed to ambient light.

Apart from photoinstability, and as stated earlier, it would be understood by those of skill in the art that thermographic recording films exposed to elevated environmental temperatures or ambient heat may exhibit thermal instability which would lead to unwanted premature interaction of the components of the thermographic image-forming system. Environmentally-induced heating of thermographic recording films utilizing thiolactone chemistry would cause the premature opening of the lactone or lactam moiety ring of the colorless thiolactone dye precursor by the Lewis acid material, resulting in an unacceptable initial, i.e., before imagewise heating, $D_{min}$.

Since, as indicated above, most preferably, the image-forming system comprises a single layer which includes an acidic organic material, that functions, in part, to liberate the $Ag^+$from the Lewis acid material, it is postulated herein that the above-described premature interactions at elevated environmental temperatures leading to undesirable $D_{min}$ values may be substantially lessened by releasably preventing the acidic organic material from interacting with the thiolactone dye precursor and the Lewis acid material, prior to imagewise heating. It was thought that a basic material capable of releasably interacting with the acid organic material in coating systems may prove useful in preventing such premature contact.

It has now been unexpectedly discovered that thermographic recording films comprising an image-forming system comprising at least one layer and including a Lewis acid material, a di- or triarylmethane thiolactone dye precursor, a light insensitive organic silver salt, an acidic organic material, a binder and a thermal stabilizer, i.e., bis[1,2,2,6,6-pentamethyl-4-piperidinyl]sebacate, exhibit excellent thermal stability at elevated environmental temperatures, as evidenced by a desirable $D_{min}$, indicative of a substantial diminution of the above-mentioned premature interactions, while providing a desirable maximum optical density ($D_{max}$).

SUMMARY OF THE INVENTION

These and other objects and advantages are accomplished in accordance with the invention by providing a thermographic recording film which comprises a support carrying an image-forming system comprising at least one layer and including a Lewis acid, a di- or triarylmethane thiolactone dye precursor, an acidic organic material, a binder and a thermal stabilizer, i.e., bis[1,2,2,6,6-pentamethyl-4-piperidinyl]sebacate.

It is preferred to use silver behenate as the Lewis acid, 3,5-dihydroxybenzoic acid as the acidic organic material, and polyvinylbutyral as the binder. Preferably, the image-forming system further includes a surfactant, preferably, a fluorocarbon surfactant.

In a preferred embodiment, the image-forming system of the invention further includes a light insensitive organic silver salt and a reducing agent for the light insensitive organic silver salt. The light insensitive organic silver salt and the reducing agent may be present in the layer comprising the Lewis acid, di- or triarylmethane thiolactone dye precursor, acidic organic material, binder and thermal stabilizer, or, preferably, are present in a separate layer further including a binder. It is preferred to use silver behenate as the light insensitive organic silver salt, methyl gallate as the reducing agent and polyvinylbutyral as the binder. It is preferred to further include a toner, preferably, phthalazinone, and a surfactant, preferably, a fluorocarbon surfactant.

It has been found that thermographic recording films comprising an image-forming system according to the present invention exhibit excellent thermal stability in elevated environmental temperatures as evidenced by a desirable $D_{min}$ value.

These and other objects and advantages which are provided in accordance with the invention will in part be obvious and in part be described hereinafter in conjunction with the detailed description of various preferred embodiments of the invention. The invention accordingly comprises the processes involving the several steps and relation and order of one or more of such steps with respect to each of the others, and the product and compositions possessing the features, properties and relation of elements which are exemplified in the following detailed disclosure, and the scope of the application of which will be indicated in the claims.

For a fuller understanding of the nature and objects of the invention, reference should be had to the following detailed description of the preferred embodiments.

DESCRIPTION OF THE PREFERRED EMBODIMENTS

The thermal stabilizer employed in the image-forming system of the present invention may be used in any amount which is required to accomplish its intended purpose, e.g., as a thermal stabilizer which substantially lessens the premature interaction of the components of the image-forming system. It will be appreciated by those of ordinary skill in the art that the amount of thermal stabilizer necessary in any specific instance is dependent upon a number of factors such as, for example, the preferred temperature at which to dry the coated layers, the type of image-forming system utilized and the specific components thereof and the result desired. The advantageous results reported herein may be accomplished by using from about 0.30 to about 0.70 parts by weight of thermal stabilizer per part by weight of acidic organic material. It is particularly preferred to use about 0.50 part by weight of thermal stabilizer per part by weight of acidic organic material, as will be appreciated from the data of Example I reported herein, i.e., the image-forming system comprises about 430.55 $mg/m^2$ 3,5-dihydroxybenzoic acid and about 215.28 $mg/m^2$ thermal stabilizer.

The thermal stabilizer is a known compound, and, as such, may be prepared using techniques which are well known to those of skill in the art. In addition, the thermal stabilizer is commercially available under the tradename Tinuvin 292 from the Ciba-Geigy AG (Basel, Switzerland).

Any suitable Lewis acid material, e.g., light insensitive organic silver salt, known in the art for use in thermographic materials may be used in the image-forming system of the present invention, such as, for example, those described in European Patent No. 250,558 and U.S. Pat. Nos. 4,904,572; 4,970,309; 5,028,725; 5,196,297; 5,198,406; 5,220,036; 5,278,127; 5,411,929; 5,480,855; and 5,489,566. It is preferred to use organic silver salts which are the silver salts of long chain aliphatic carboxylic acids, i.e., aliphatic carbon chains comprising at least twelve carbon atoms, particularly, silver behenate which may be used in admixture with other organic silver salts if so desired. Also, behenic acid may be used in combination with silver behenate.

The organic silver salts including silver behenate may be prepared in a conventional manner using any of the various procedures well known in the art, such as, for example, those described in European Patent No. 250,558, and in U.S. Pat. Nos. 3,458,544; 4,028,129 and 4,273,723; or, purchased from any of a variety of commercial suppliers. The preparation of such organic silver salts is generally carried out by processes which comprise mixing a silver salt forming organic compound dispersed or dissolved in a suitable liquid with an aqueous solution of a silver salt such as silver nitrate or a silver complex salt.

The di- or triarylmethane thiolactone dye precursors of the image-forming system of the present invention will now be described in detail. The thiolactone dye precursors may be represented by formula (I)

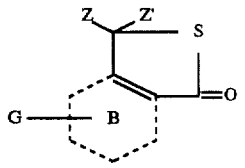

(I)

wherein:

ring B represents a substituted or unsubstituted carbocyclic aryl ring or rings, e.g., of the benzene or naphthalene series or a heterocyclic ring, e.g., pyridine or pyrimidine;

G is hydrogen or a monovalent radical; and

Z and Z'taken individually represent the moieties to complete the auxochromophoric system of a diarylmethane or a triarylmethane dye when the sulfur-containing ring is open and Z and Z'taken together represent the bridged moieties to complete the auxochromophoric system of a bridged triarylmethane dye when the sulfur-containing ring is open, i.e., when the ring sulfur atom is not bonded to the meso carbon atom.

Usually, at least one of Z and Z,'whether taken individually or together, possesses as an auxochromic substituent, a nitrogen, oxygen or sulfur atom or a group of atoms containing nitrogen, oxygen or sulfur.

In a preferred embodiment, B is a benzene ring and Z and Z'taken individually or together complete the auxochromophoric system of a triarylmethane dye.

The thiolactone dye precursor compounds used in this embodiment of the invention can be monomeric or polymeric compounds. Suitable polymeric compounds are those which, for example, comprise a polymeric backbone chain having dye precursor moieties attached directly thereto or through pendant linking groups.

Polymeric compounds of the invention can be provided by attachment of the dye precursor moiety to the polymeric chain via the Z and/or Z'moieties or the ring B. For example, a monomeric dye precursor compound having a reactable substituent group, such as an hydroxyl or amino group, can be conveniently reacted with a monoethylenically unsaturated, polymerizable compound having a functional and derivatizable moiety, to provide a polymerizable monomer having a pendant dye precursor moiety.

Suitable monoethylenically unsaturated compounds for this purpose include acrylyl chloride, methacrylyl chloride, methacrylic anhydride, 2-isocyanatoethyl methacrylate and 2-hydroxyethyl acrylate, which can be reacted with an appropriately substituted dye precursor compound for production of a polymerizable monomer which in turn can be polymerized in a known manner to provide a polymer having the dye precursor compound pendant from the backbone chain thereof.

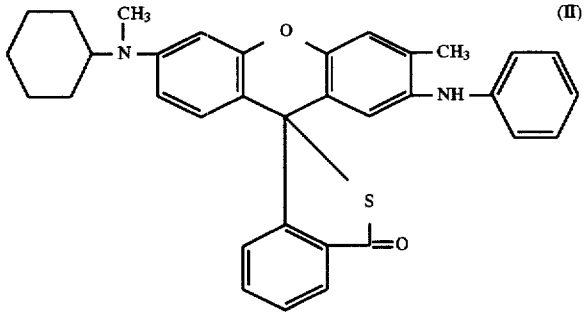

(II)

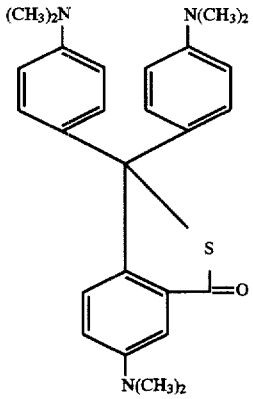

(III)

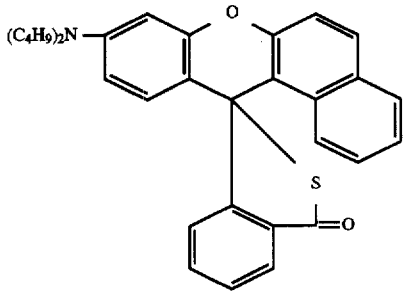

(IV)

The thiolactone dye precursors can be synthesized as is well known to the art, such as, for example, from the corresponding lactones by heating substantially equimolar amounts of the lactone and phosphorus pentasulfide or its equivalent in a suitable solvent, or, for example, as described in U.S. Pat. No. 4,904,572 or in European Patent No. 250,558.

The thiolactone dye precursors depicted above are selected to give the desired color. Preferably, the image-forming system of the present invention utilizes both the black and blue dye precursors; however, use of the blue dye precursor alone would be sufficient to attain the desired results described herein. In addition, the red dye precursor may be used in combination with the black and blue dye precursors or with the blue dye precursor alone to achieve the desired results.

Any suitable acidic organic material known in the art for use in thermographic materials, such as, for example, a phenol or an organic carboxylic acid, particularly, a hydroxy-substituted aromatic carboxylic acid, may be used in the thermographic recording films of the present invention. In addition, any suitable combination of acidic organic materials can be employed in the present invention. It is preferred to use 3,5-dihydroxybenzoic acid as the acidic organic material Any suitable binder or plurality of suitable individual binder materials know in the art for use in thermographic materials may be used in the image-forming system of the present invention provided that the binder does not have any adverse effect on the other constituents of the thermographic recording film and is heat-stable at the desired processing temperatures.

Suitable binders include hydrophobic binders, such as, for example, polyvinylbutyral, cellulose acetate or ethyl cellulose; hydrophilic binders, such as, for example, gelatin, polyvinylalcohol or hydroxyethylcellulose; including those described in European Patent No. 250,558 and U.S. Pat. No. 5,196,297. It is preferred to use polyvinylbutyral, preferably, BUTVAR-76® which is commercially available from Monsanto (St. Louis, Mo.), as the binder. Preferably, a surfactant, more preferably, a fluorocarbon surfactant, preferably, FC-431 which is commercially available from the Minnesota Mining and Manufacturing Company (St. Paul, Minn.), is present together with the binder.

As stated above, the novel image-forming system of the present invention may further include a light insensitive organic silver salt and a reducing agent for the light insensitive organic silver salt, together with the Lewis acid material, di- or triarylmethane thiolactone dye precursor, acidic organic material, binder and thermal stabilizer, or, may be present in a separate layer. If the light insensitive organic silver salt and the reducing agent therefor are present in a separate layer, it is preferred that this layer further include a binder, preferably, polyvinylbutyral.

A thermographic recording material comprising an image-forming system which includes a Lewis acid material, a di- or triarylmethane thiolactone dye precursor, organic acidic material, binder, thermal stabilizer, light insensitive organic silver salt and reducing agent is disclosed and claimed in commonly-assigned, copending U.S. patent application, Ser. No. 08/837,701, filed on even date herewith.

Any suitable light insensitive organic silver salt, as described above, and any suitable reducing agent known in the art for use in thermographic materials may be used in the image-forming system of the present invention, such as, substituted and unsubstituted hydroquinone, hindered phenols, catechol and pyrogallol. It is preferred to use methyl gallate to reduce the silver ion. In addition, in embodiments wherein the image-forming system includes a light insensitive organic silver salt and a reducing agent therefor, it is preferred to further include a toning agent. Any suitable toning agent known in the art for use in thermographic recording films may be used in the image-forming system of the present invention, such as, for example, phthalazinone, phthalazine and phthalimide. It is particularly preferred to use phthalazinone as the toning agent.

Any suitable additive known in the art for use in thermographic materials may be used in the image-forming system of the present invention, such as, for example, a surfactant and/or a development accelerator.

Any of the numerous suitable supports known in the art for use in thermographic materials may be used in the present invention, including transparent and reflective supports. Suitable transparent support substrates include: polyesters, polycarbonates, polystyrenes, polyolefins, cellulose esters, polysulfones and polyimides. Specific examples of suitable transparent support substrates include: polypropylene, cellulose acetate and polyethylene terephthalate. It is preferred to use polyester as the support in the thermographic recording films of the invention. Suitable reflective supports include: polyethylene clad paper (Glory Mill Papers Limited, England) and Baryta coated paper (Schoeller Technical Papers Inc., N.Y.).

In addition to the layer or layers containing the above-named components, the thermographic recording film of the present invention may contain any suitable additional layers known in the art for use in thermographic recording films, such as, subbing layers to improve adhesion to the support; interlayers or barrier layers for thermally and chemically isolating the respective organic silver salt/dye precursor layer(s) from each other; infrared (IR) absorbing layers; UV absorbing layers; antihalation layers; antistatic layers; back coat layers on the support; protective layers; and, other auxiliary layers.

Furthermore, for use as magnetic tickets, e.g., commuter tickets and passes, a magnetic recording layer may be carried on the back of the support opposite the imaging layer(s). Likewise, for use as adhesive labels, an adhesive layer may be coated on the back of the support and a disposable backing sheet attached to the adhesive layer.

It is preferred to use a protective layer, such as, for example, a topcoat layer or an overcoat layer, in the thermographic recording films of the present invention to, e.g., reduce abrasion, fingerprints, streaking, gouging, print head build-up and static electricity; improve shelf stability; enhance the transparency of the image formed, and for any other desirable effect or result which would be appreciated by one of skill in the art.

It is preferred to use a topcoat in the thermographic recording films of the present invention. Any suitable topcoat layer known in the art for use in thermographic recording materials may be used in the present invention, such as, for example, those described in U.S. Pat. Nos. 5,198,406; 5,278,127; 5,480,855; and 5,489,566 which discloses a protective layer(s) which comprises colloidal silica, a crosslinking compound and polyvinyl alcohol that prevents gouging, reduces thermal print head build-up, enhances print performance and improves the quality of the printed image); and, those comprising chrome-hardened polyvinyl alcohol, methacrylic acid-diacrylamide copolymers and arylsulfonamideformaldehyde condensation resins containing a fluorocarbon surfactant. For example, a topcoat layer comprising a high molecular weight (MW) polyurethane latex (PU 1514, commercially available from B.F. Goodrich (Akron, Ohio)) and a crosslinking compound (CX-100, commercially available from Zeneca (Wilmington, Del.)) may also be used in the thermographic recording films of the invention.

To prevent interaction of the components in the protective layer with those in the solvent soluble imaging layers beneath it and to ameliorate the environmental concerns associated with the coating from solvents, the protective layer is preferably coated out of aqueous systems. If the binders employed in the protective layer are water-insoluble, they are, preferably, either coated as latex emulsions or they are made water soluble by mixing with alkali, preferably aqueous ammonia which is lost upon drying. The protective layer may be prepared and coated either as an aqueous dispersion or as an aqueous solution over the image-forming system.

It is preferred to use an overcoat layer in the thermographic recording films of the present invention. Any suitable overcoat layer known in the art for use in thermographic recording materials may be used in the present invention. The overcoat layer may comprise any organic solvent-soluble or water-soluble polymer or resin and preferably contains a fluorochemical surfactant. In addition, the overcoat layer may contain any other material known in the art to be commonly employed in such layers, such as, for example, UVAs, matting agents, lubricating agents such as polytetrafluoroethylene, higher fatty acids and/or waxes.

Suitable polymers for the overcoat layer include polyvinyl chloride, polyvinyl acetate, copolymers of vinyl chloride and vinyl acetate, polyvinylbutyral, polystyrene, polymethyl methacrylate, polyurethane, xylene resins, benzyl cellulose, ethyl cellulose, cellulose acetate butyrate, cellulose acetate, triacetate, polyvinylidene chloride, chlorinated polypropylene, polyvinylpyrrolidone, cellulose propionate, polyvinyl formal, cellulose acetate phthalate, polycarbonate and cellulose acetate propionate.

It is preferred to use a washcoat layer in the thermographic recording films of the present invention. Any suitable washcoat layer known in the art for use in thermographic recording films may be used in the present invention. For example, a washcoat having anti-slip properties may be used which comprises CYASTAT-SN (stearimidipropyl-dimethyl-β-hydroxyethylammonium nitrate), ZONYL FSN, CYASTAT 609 (N,N'-Bis[2-hydroxyethyl]-N-[3'-dodecyl-oxy-2-hydroxypropyl] methylammonium methosulfate), Michelman Emulsion (ME 03230 silicone filtered, Silverson mixer) and a diepoxy crosslinking compound (1,4-butanediol diglycidyl ether).

As stated earlier, any suitable materials known in the art to prevent sticking of a thermographic recording film to, e.g., a thermal print head, may also be used in the present invention. For example, waxes, silica particles, styrene-containing elastomeric block polymers, e.g., styrene-butadiene-styrene, styrene-isoprene-styrene, and blends thereof with such materials as cellulose acetate, cellulose acetate butyrate and cellulose acetate propionate, may be used in the present invention. Also useful are ethylene-vinyl acetate copolymer and a terpolymer comprising chlorotrifluoroethylene, vinylidene fluoride and hexafluoropropylene.

The respective components described above for use in the thermographic recording films of the present invention may be used in any amount which is required to accomplish their intended purpose. The amount necessary in any specific instance is dependent upon a number of factors such as, for example, the specific materials utilized and the result desired. Routine scoping tests may be conducted to ascertain the concentration which is appropriate for any given thermographic recording film.

The layers of the thermographic recording film of the present invention may be coated on a suitable support, in any desirable order, by any suitable method known to those skilled in the art, e.g., coating by loop, slot, spray, air-knife, roll, dip, curtain, extrusion, hopper, silkscreen or reverse roll. If desired two or layers can be coated simultaneously.

In addition, the coating compositions may contain dispersing agents, surfactants, preferably, FC-431, lubricants, preferably, polytetrafluoroethylene, plasticizers, defoaming agents, coating aids, pigments, e.g., to provide a white background or a contrasting color for the dye image formed, and so forth. Preferably, the layers of the thermographic recording films of the present invention are coated using a loop coater.

It is preferred to coat the imaging layer(s) from about a 10–15% methyl ethyl ketone solution onto a polyester base (4 mil) using a loop coater. In embodiments wherein the image-forming system comprises a first layer which includes a Lewis acid material, a di- or triarylmethane thiolactone dye precursor, an acidic organic material, a binder and a thermal stabilizer and a second layer comprising a light insensitive organic silver salt, a reducing agent therefor and a binder, it is preferred to coat the first layer before coating the second layer.

After coating, the thermographic recording films of the present invention may be dried in any suitable manner as is known in the art. It is preferred to dry the thermographic recording films of the present invention at elevated temperature, e.g., 60° C., and, as mentioned previously, another advantage of the thermal stabilizer of the present invention is the ability to dry the recording films at even higher temperatures, if so desired, without causing substantial premature interactions of the reactive components of the image-forming system, as described above.

Any suitable method of applying heat or inducing heat imagewise known in the art for use in thermographic materials may be used in the present invention, such as, for example, (1) by direct application of heat using a thermal printing head or thermal recording pen; (2) by conduction from heated image-markings of an original using conventional thermally-processable copying techniques; (3) by heat generated in response to an electric signal by including, for example, an electroconductive material or a resistive layer; or, (4) by the conversion of electromagnetic radiation, e.g., from any suitable laser beam emitting source such as a gas laser, a solid state laser, a dye laser or a semiconductor laser diode, into heat, by use of a light-to-heat converting material. It is preferred to bring the thermographic recording films of the present invention into direct contact with the thermal head of a thermal printing head whereby an image is formed by imagewise heating of the media.

The invention will now be described further in detail with respect to specific preferred embodiments by way of examples, it being understood that these are intended to be illustrative only and the invention is not limited to the materials, conditions, process parameters, etc. recited therein. All parts and percentages recited are by weight unless otherwise stated.

EXAMPLE I

Eight thermographic recording films were prepared: four "Test" films were prepared according to the present invention, i.e., the image-forming system incorporated therein comprised at least one layer and included a Lewis acid, a di- or triarylmethane thiolactone dye precursor, an acidic organic material, a binder and a thermal stabilizer, i.e., bis[1,2,2,6,6-pentamethyl-4-piperidinyl]sebacate, which was purchased under the tradename Tinuvin 292 (Ciba-Geigy AG); and, four "Control" films were prepared in the same manner as the Test films but excluded the thermal stabilizer, as further described below.

The imaging layer(s) were coated from a 10–15% methyl ethyl ketone solution onto the polyester base (4 mil) using a loop coater and then dried at 60° C. The amounts of the materials used in each of the layers were calculated to give, after drying, the indicated coated coverages.

TABLE I

| | COVERAGE (mg/m²) | |
|---|---|---|
| MATERIAL | Control | Test |
| Silver Behenate | 1339.34 | 1339.34 |
| Polyvinylbutyral (Butvar-76, Monsanto) | 4090.27 | 4090.27 |
| Leuco Thiolactone Dyes (black:blue, 50:50) (formulae (II) and (III) herein) | 430.56 | 430.56 |
| 3,5-dihydroxybenzoic acid | 430.55 | 430.55 |
| bis[1,2,2,6,6-pentamethyl-4-piperidinyl] sebacate | — | 215.28 |

For the determination of visual minimum optical density, three of the Test films and three of the Control films were imaged, one day after the films were prepared, at room temperature ("baseline") or by means of an oven at either 70° C. for 120 minutes ("70° C."), or 80° C. for 5 minutes ("80° C."), respectively. The minimum optical densities of these films were determined using an Xrite recorder, and the $D_{min}$ values are reported in TABLE II.

TABLE II

| FILM | baseline | 70° C. | 80° C. |
|---|---|---|---|
| Control | 0.026 | 0.123 | 0.083 |
| Test | 0.023 | 0.077 | 0.047 |

For the determination of visual maximum optical density, one Test film and one Control film were imaged by means of a hot plate at 120° C. for 90 seconds, one day after the films were prepared. The maximum optical densities of these films were determined using an Xrite recorder, and the $D_{max}$ values, as well as the $D_{min}$ values, are reported in TABLE III.

TABLE III

| | $D_{max}$ | $D_{min}$ |
|---|---|---|
| Control | 1.51 | 0.026 |
| Test | 1.53 | 0.023 |

As will be appreciated from the data reported in TABLEs III and IV, thermographic recording films exposed to elevated environmental temperatures exhibit substantially lower $D_{min}$ if prepared according to the present invention, i.e., the image-forming system incorporated therein comprises bis[1,2,2,6,6-pentamethyl-4-piperidinyl]sebacate, and desirable image density.

EXAMPLE II

Three thermographic recording films were prepared: "A" was prepared according to the invention, i.e., the image-forming system incorporated therein comprised in a layer a Lewis acid, a di- or triarylmethane thiolactone dye precursor, an acidic organic material, a binder and a thermal stabilizer, i.e., bis[1,2,2,6,6-pentamethyl-4-piperidinyl] sebacate, which was purchased under the tradename Tinuvin 292 (Ciba-Geigy, AG); "B" was prepared in the same manner as "A" but further included, in a separate layer, a light insensitive organic silver salt, a reducing agent, a toning agent and a binder material; the image-forming system of "C" comprised, in a layer, a light insensitive organic silver salt, a reducing agent, a toning agent and a binder material, as further described below.

The imaging layers were coated from a 10–15% methyl ethyl ketone solution onto the polyester base (4 mil) using a loop coater and then dried at 60° C. The amounts of the materials used in each of the layers were calculated to give, after drying, the indicated coated coverages.

TABLE V

| MATERIAL | Coverage (mg/m$^2$) A & First Imaging Layer of B |
|---|---|
| Silver Behenate | 1339.34 |
| Polyvinylbutyral (Butvar-76, Monsanto) | 4090.27 |
| Leuco Thiolactone Dyes (black:blue, 50:50) (formulae (II) and (III) herein | 430.56 |
| 3,5-dihydroxybenzoic acid | 430.55 |
| bis[1,2,2,6,6-pentamethyl-4-piperidinyl] sebacate | 215.28 |

TABLE V-continued

| MATERIAL | Coverage (mg/m$^2$) C & Second Imaging Layer of B |
|---|---|
| Silver Behenate | 4018.11 |
| Methyl Gallate | 1646.68 |
| Phthalazinone | 209.94 |
| Polyvinylbutyral | 5084.76 |

For the determination of visual $D_{max}$, thermographic recording films "A," "B" and "C" were imaged by means of a hot plate at 120° C. for 90 seconds. $D_{max}$ was determined using an Xrite recorder.

The $D_{max}$ values for thermographic recording films "A," "B" and "C" were 1.5, 3.0 and 1.37, respectively. As will be appreciated from a comparison of the $D_{max}$ values for thermographic recording films "A" and "C" with "B," an image-forming system utilizing both thiolactone and silver reduction chemistries results in an image of substantially higher density than an image-forming system utilizing either of the chemistries individually.

Although the invention has been described in detail with respect to various preferred embodiments thereof, those skilled in the art will recognize that the invention is not limited thereto but rather that variations and modifications can be made which are within the spirit of the invention and the scope of the appended claims.

What is claimed is:

1. A thermographic recording film comprising a support carrying an image-forming system comprising at least one layer including a Lewis acid material, a di- or triarylmethane thiolactone dye precursor, an acidic organic material, a first binder and bis[1,2,2,6,6-pentamethyl-4-piperidinyl] sebacate, wherein said image-forming system comprises from about 0.30 about 0.70 parts by weight of bis[1,2,2,6,6-pentamethyl-4-piperidinyl]sebacate per part by weight of acidic organic material.

2. A thermographic recording film as defined in claim 1 wherein said Lewis acid material is a light insensitive organic silver salt.

3. A thermographic recording film as defined in claim 2 wherein said light insensitive organic silver salt is a silver salt of an aliphatic carboxylic acid that comprises an aliphatic carbon chain, said aliphatic carbon chain comprising at least twelve carbon atoms.

4. A thermographic recording material as defined in claim 3 wherein said silver salt is silver behenate.

5. A thermographic recording film as defined in claim 1 wherein said acidic organic material is 3,5-dihydroxybenzoic acid.

6. A thermographic recording film as defined in claim 1 wherein said first binder is polyvinylbutyral.

7. A thermographic recording film as defined in claim 1 further including a fluorocarbon surfactant.

8. A thermographic recording film as defined in claim 7 wherein said Lewis acid material is silver behenate, said acidic organic material is 3,5-dihydroxybenzoic acid and said first binder is polyvinylbutyral.

9. A thermographic recording film as defined in claim 1 wherein said image-forming system comprises about 0.50 parts by weight of bis[1,2,2,6,6-pentamethyl-4-piperidinyl] sebacate per part by weight of acidic organic material.

10. A thermographic recording film as defined in claim 1 wherein said image-forming system further includes a light insensitive organic silver salt and a reducing agent.

11. A thermographic recording film as defined in claim 10 wherein said light insensitive organic silver salt and said reducing agent are in a first layer separate from said Lewis acid material, said di- or triarylmethane thiolactone dye precursor, said acidic organic material, said first binder and said bis[1,2,2,6,6-pentamethyl-4-piperidinyl]sebacate, wherein said first layer further includes a second binder.

12. A thermographic recording film as defined in claim 11 wherein said first layer further includes a toning agent.

13. A thermographic recording film as defined in claim 11 wherein said first layer further includes a fluorocarbon surfactant.

14. A thermographic recording film as defined in claim 11 wherein said light insensitive organic silver salt is a silver salt of an aliphatic carboxylic acid that comprises an aliphatic carbon chain, said aliphatic carbon chain comprising at least twelve carbon atoms.

15. A thermographic recording film as defined in claim 14 wherein said first layer further includes phthalazinone and a fluorocarbon surfactant, and said silver salt is silver behenate, said reducing agent is methyl gallate and said second binder is polyvinylbutyral.

16. A thermographic recording film as defined in claim 11 wherein said Lewis acid material, said di- or triarylmethane thiolactone dye precursor, said acidic organic material, said first binder and said bis[1,2,2,6,6-pentamethyl-4-piperidinyl]sebacate are in a second layer.

17. A thermographic recording film as defined in claim 16 wherein said first layer is positioned above said second layer, remote from said support.

18. A thermographic recording film as defined in claim 16 wherein said first layer is adjacent said second layer, remote from said support.

19. A thermographic recording film as defined in claim 16 further including at least one protective layer.

20. A thermographic recording film as defined in claim 10 wherein said first layer is positioned above said Lewis acid material, said di- or triarylmethane thiolactone dye precursor, said acidic organic material, said first binder and said bis[1,2,2,6,6, -pentamethyl-4-piperidinyl]sebacate, remote from said support.

21. A thermographic recording film as defined in claim 1 further including at least one protective layer.

* * * * *